US010617176B2

(12) United States Patent
Horvath et al.

(10) Patent No.: US 10,617,176 B2
(45) Date of Patent: Apr. 14, 2020

(54) DEVICE FOR DRAWSTRING ACTUATION

(71) Applicant: Parvayim Anstalt, Vaduz (LI)

(72) Inventors: Milos Horvath, Goenyue (HU); Armin Voswinkel, Langweid (DE)

(73) Assignee: Parvayim Anstalt, Vaduz (LI)

( * ) Notice: Subject to any disclaimer, the term of this patent is extended or adjusted under 35 U.S.C. 154(b) by 0 days.

(21) Appl. No.: 16/364,963

(22) Filed: Mar. 26, 2019

(65) Prior Publication Data

US 2019/0216175 A1 Jul. 18, 2019

Related U.S. Application Data

(63) Continuation of application No. PCT/EP2017/000928, filed on Jul. 31, 2017.

(30) Foreign Application Priority Data

Aug. 30, 2016 (DE) ..... 10 2016 010 382

(51) Int. Cl.
*A43C 11/00* (2006.01)
*B65H 75/44* (2006.01)
(Continued)

(52) U.S. Cl.
CPC ..... *A43C 11/165* (2013.01); *A43C 11/008* (2013.01); *B65H 75/4431* (2013.01); *B65H 75/486* (2013.01); *Y10T 24/2183* (2015.01)

(58) Field of Classification Search
CPC ..... A43C 11/008; A43C 11/165; A43C 11/00; A43C 1/00; Y10T 24/2183;
(Continued)

(56) References Cited

U.S. PATENT DOCUMENTS 7,721,468 B1 5/2010 Johnson et al.
8,904,672 B1 * 12/2014 Johnson ..... A43C 11/165 36/138
(Continued)

FOREIGN PATENT DOCUMENTS

KR 20140055653 A 5/2014
KR 101614858 B1 4/2016
WO 2012077899 A2 6/2012

OTHER PUBLICATIONS

International Search Report of the European Patent Office in PCT/EP2017/000928 (from which this application claims priority) dated Feb. 10, 2017 and English-language translation thereof.

*Primary Examiner* — Robert Sandy
*Assistant Examiner* — Michael S Lee
(74) *Attorney, Agent, or Firm* — Falk Ewers; Ewers IP Law PLLC

(57) ABSTRACT

A device for actuating a drawstring in a shoe with a drawstring device includes a winding disc, an actuating member movable in the axial direction relative to the winding disc, and a return spring arrangement which counteracts the force exerted by the wearer of the shoe. A simpler and clearer construction and a high level of functional safety and reliability can be achieved in that the carrier embedded in the sole of the shoe is designed as a closed housing with a base and a cover penetrated by an upper pushbutton of the actuating member. A fixed pin protrudes from the base of the housing and is assigned to a central through recess of the winding disc. The return spring arrangement engages on the winding disc and/or the actuating member and, when the blocking device is released, returns the winding disc and the actuating member to the respective starting position.

11 Claims, 5 Drawing Sheets

(51) Int. Cl.
*B65H 75/48* (2006.01)
*A43C 11/16* (2006.01)

(58) Field of Classification Search
CPC ..... Y10T 24/2158; Y10T 24/2106; Y10T 24/2142; Y10T 24/37
See application file for complete search history.

(56) References Cited

U.S. PATENT DOCUMENTS

| | | | | |
|---|---|---|---|---|
| 2005/0039348 | A1* | 2/2005 | Raluy | A43B 3/12 36/50.1 |
| 2005/0198867 | A1 | 9/2005 | Labbe | |
| 2006/0053659 | A1* | 3/2006 | Johnson | A43B 11/00 36/56 |
| 2007/0209234 | A1* | 9/2007 | Chou | A43B 11/00 36/50.1 |
| 2016/0302530 | A1* | 10/2016 | Smith | A43C 11/004 |
| 2019/0208855 | A1* | 7/2019 | Raia | A43B 3/163 |

* cited by examiner

DEVICE FOR DRAWSTRING ACTUATION

CROSS REFERENCE TO RELATED APPLICATIONS

This application is a continuation application of international patent application PCT/EP2017/000928, filed Jul. 31, 2017, designating the United States and claiming priority to German application 10 2016 010 382.5, filed Aug. 30, 2016, and the entire content of both applications is incorporated herein by reference.

TECHNICAL FIELD

The invention relates to a device for actuating a drawstring in a shoe provided with a drawstring device, having a winding member, which is rotatably arranged on a carrier embedded in the sole of the shoe, is stationary in the axial direction and on which at least one drawstring element, which can be wound on it, engages, and having an actuating member, which is movable in the axial direction relative to the winding member, can be depressed by the wearer of the shoe and is thereby blocked in the direction of rotation, is in screw engagement with the winding member, can be rotated in the tensioning direction by the depressible actuating member and can be blocked in the tensioning position by means of a blocking device, which can be released by means of a release member which can be actuated from the outside, and having a return spring arrangement which counteracts the force exerted by the wearer of the shoe and acts on the winding member and/or actuating member and, when the blocking device is released, returns the winding member and the actuating member to the respective starting position, wherein the carrier has a fixed pin which is assigned to a central through recess of the winding member, has a non-circular cross-section and onto which the actuating member, which has a corresponding recess, can be fitted with freedom of movement in the axial direction.

BACKGROUND

A device of this type is known from the KR 10 2014 00 55 653 A. In this known arrangement, a simple plate is provided as the carrier, from which a vertical pin with laterally projecting guide rails protrudes, onto which an actuating member provided with a corresponding recess and blocked in the direction of rotation by the guide rails is slidable in the axial direction, which is provided with an external thread and co-operates therewith with a threaded bushing, which surrounds it and is provided with an internal thread, which is connected via a circumferential freewheel coupling to a winding drum which surrounds it, on which the drawstring elements engage and which co-operates with a blocking device. This well-known arrangement requires a high construction effort and leads to a large construction height.

U.S. Pat. No. 7,721,468 B1 discloses a further device for drawstring actuation, in which a housing acting as a carrier and insertable into a recess in the sole of the shoe is provided, in which a vertical bearing pin extending between the housing, base and cover is provided, on which a disc pack with a winding disc for the drawstring elements and a drive disc arranged thereabove for receiving a drive cable is received in an axially rotatable manner. The winding disc on which the drawstring elements engage is provided on its lower and upper sides with wedge-shaped ratchet elements which, on the one hand, cooperate with ratchet elements provided on the bottom side and, on the other hand, with ratchet elements provided on the underside of the drive disc in opposite directions, in each case locking in one direction and not locking in the other direction. This well-known arrangement also requires a great deal of construction work as a result of the ratchet elements required and leads to a comparatively large overall height as a result of the axial movement of the disc pack. The discs of the disc pack are mounted on the assigned bearing pin only in the radial direction. An axial bearing is not possible due to the axial mobility.

Another device for drawstring actuation is known from US 2005/01 98767 A. The carrier is an annular body embedded in the sole of the shoe, which provides an open space at the top and bottom for the winding disc, the storage of which is therefore difficult. In the known arrangement, the winding disc and the actuating member in screw engagement therewith are each connected to a pawl wheel in which an associated pawl engages, allowing rotation in only one direction. When the actuating member is pressed down, it is blocked in such a way that a rotation of the winding disc, which is in screw engagement with it, is induced and vice versa. The rotation of the winding disc only takes place against the pull of the drawstring elements.

No return spring is provided which engages or interacts with the winding disc and/or the actuating member. It is therefore difficult to return the winding disc and the actuating member to their initial position. In the known arrangement, a return spring is provided. However, the latter is located between the carrier embedded in the sole and a flap pivotally attached thereto and formed by the rear portion of an insole and serves only to establish a latent state of equilibrium between the force exerted by the wearer of the shoe and the force transmitted by the drawstring elements. This well-known arrangement also has a comparatively complicated structure and is not functionally safe and reliable enough.

SUMMARY

It is therefore an object of the present invention to avoid the disadvantages of the aforementioned prior art and to create a device for drawstring actuation of the type mentioned at the beginning, which has a comparatively simple and clear structure and makes do with a low overall height and nevertheless guarantees a high functional safety and reliability.

This object is achieved according to the invention in that the carrier embedded in the sole of the shoe is designed as a closed housing with a base from which the pin protrudes and with a cover penetrated by an upper pushbutton of the actuating member, and that the winding member is designed as a winding disc, which is mounted in ball bearings with respect to the base or/and the cover of the housing, wherein a circumferential ball ring is provided in each case, which runs at least at the top or bottom in an associated circumferential track groove. Since the carrier assigned to the winding disc forms a closed housing, not only can the winding disc be reliably stored in it, but is also guaranteed by a dirt-proof mounting of the winding disc. Due to the out-of-round pin protruding from the base of the housing, the actuating member in screw engagement with the winding disc is locked both during the downward and upward movement in the direction of rotation, so that during the downward movement it rotates the winding disc in the direction of tension and is itself returned to its initial position by the return of the winding disc. The ball bearing of the winding disc increases its smooth running in an advantageous way. At the same time, the track grooves not only provide a reliable axial bearing but also a reliable radial bearing and thus not only a particularly smooth running but also a high degree of reliability and immunity from malfunctions.

For example, the winding disc can be provided with screw-thread grooves arranged in the manner of an internal thread in the area of its central recess and the actuating member designed as a cylinder section can be provided with corresponding screw-thread webs arranged in the manner of an external thread in the area of its section which can be screwed into the winding disc. The screw-thread grooves and screw-thread webs allow an advantageous large-area mutual contact and thus a force distribution which is favorable for smooth operation. In this sense, it can be particularly advantageous if the pitch of the screw-thread surfaces of the winding disc and actuating member is approximately 23° to 26°, preferably exactly 24.5°.

In further development of the superordinate measures, the winding disc may have an arc slot concentric with its central through recess, in which arc slot a return spring, preferably in the form of a correspondingly curved helical tension spring, is received, which spring engages on the one hand on the winding disc and on the other hand on a retaining pin projecting from the base of the housing and engaging in the arc slot. These measures result in a particularly compact and space-saving arrangement of the return spring acting directly on the winding disc. The base and/or the cover of the housing can each have a guide groove assigned to the bent return spring. This ensures that the bent helical tension spring runs in a largely closed tunnel and is therefore reliably secured against radial and axial deflection, which increases functional reliability.

A further practical measure may be that the winding disc has a further arc slot which is concentric relative to its central through recess and into which a stop pin engages which also projects from the base of the housing and limits a rotation of the winding disc. This ensures that the winding disc cannot be twisted too far, which further increases the functional reliability.

The winding disc can functionally have at least one suspension element provided in the region of its circumference for the suspension of an associated drawstring element, which can be guided out of the housing via a circumferential housing opening. These measures make it easy to fit and remove the drawstring elements and thus simplify their interchangeability.

In a further development of the superordinate measures, a pressure plate made of comparatively stiff material, preferably embedded in a recess of an insole or insert sole of the shoe, can be assigned to the upper pushbutton of the actuating member which reaches through the cover of the housing. This counteracts a point load on the heel of the wearer of the shoe, which increases wearing comfort. At the same time, reliable power transmission to the actuating member is guaranteed.

In a further development of the superordinate measures, the housing receiving the winding disc can comprise a radial housing attachment for receiving a radially movable latch which can be brought into engagement in a circumferential latching recess of the winding disc and the outwardly guided release member together with a respectively associated slider arrangement. These measures result in a simple and compact design as well as simple and reliable installation capability of the locking and release device. Spring-loaded sliders, which interact with each other via a rotatable, two-armed rocker, can be assigned to the latch and the release device. This ensures that the latch can automatically engage in the circumferential latching recess of the winding disc when the release element is not actuated.

A further advantageous measure may be that each drawstring element extends outside the housing in a channel provided on the sole side, which is preferably provided with a cover and in which preferably at least one spring is arranged, which is penetrated by the associated drawstring element and is supported on the one hand thereon and on the other hand on the channel side. These measures result in a protected and thus low-friction and low-wear arrangement of the drawstring elements, which leads to a reliable opening of the drawstring device when the blocking device is triggered, which can be further supported by the springs provided on the channel side.

BRIEF DESCRIPTION OF THE DRAWINGS

The invention will now be described with reference to the drawings wherein.

DESCRIPTION OF EXEMPLARY EMBODIMENTS

Figure 1:
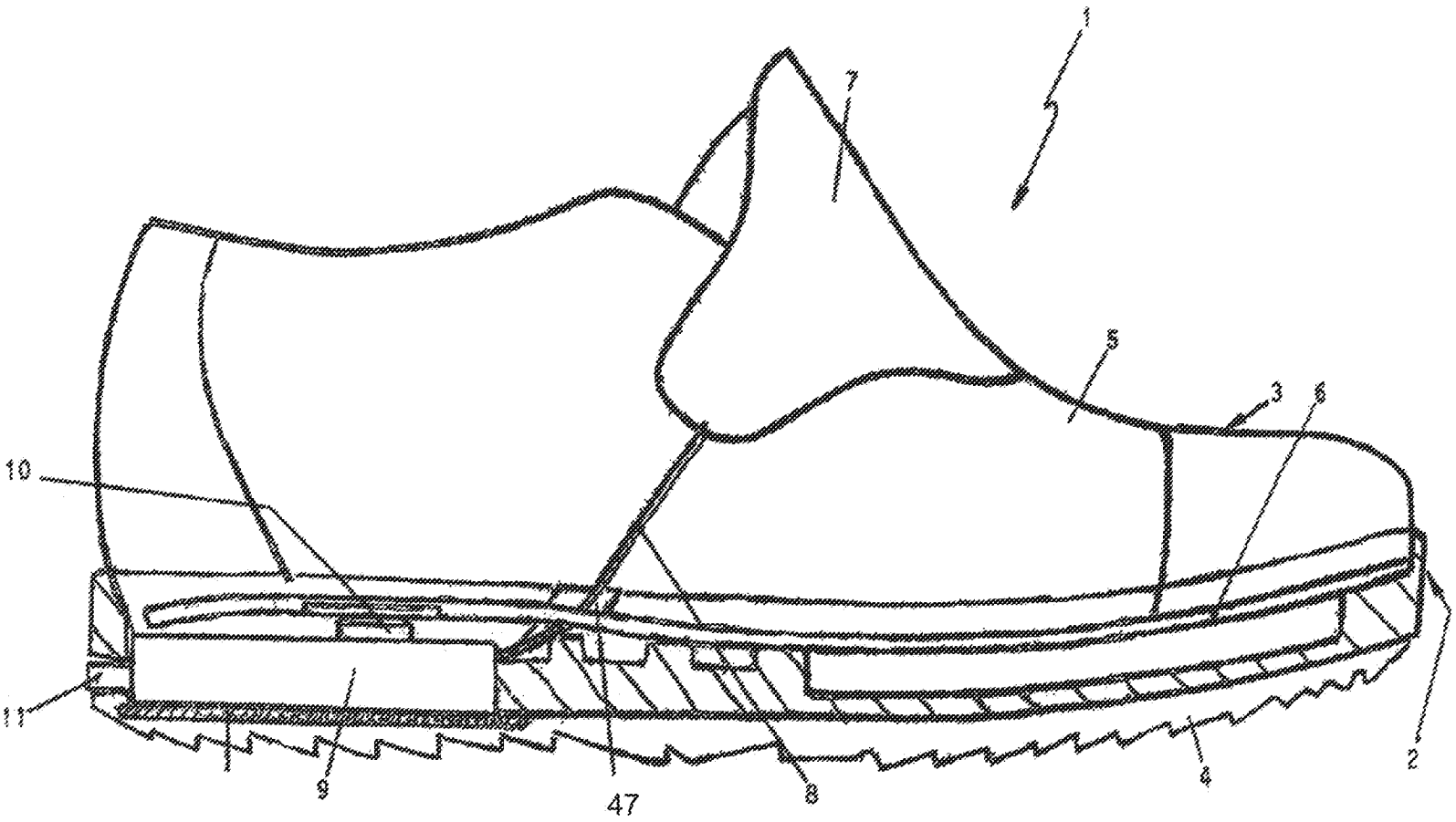
FIG. 1 shows a schematic representation of a shoe fitted with a device according to an exemplary embodiment of the invention.

The shoe 1 based on FIG. 1 consists of a lower part formed by a sole 2 and an upper part 3 received thereon and bounding an interior space. The sole 2 forming the lower part is formed here as a shell sole formed by a molded part to which a tread 4 is attached. The upper part 3 contains shafts 5 connected by seams, which may be attached to an insole not shown in more detail, with which the upper part 3 may be attached to the sole 2. In the example shown, an insert sole 6 is also provided which is inserted into the interior and possibly covers the insole.

The upper part 3 has an expansion slot in the instep area not visible in FIG. 1, which is overlapped by a cover flap 7, at the ends of which drawstring elements 8 engage, which can be tensioned to tension the cover flap 7 and vice versa. If the cover flap 7 is attached on one side, a drawstring element 8 assigned to the loose side of the cover flap 7 is sufficient. The drawstring elements 8 can be formed by comparatively pressure-resistant plastic straps which can function as pulling and pushing elements. The drawstring elements 8 may also be provided with hooks assigned to their ends on the cover flap side, which are not shown here in detail, and may thus be hooked into eyelets attached to the flap side, which are not shown here in detail, wherein several eyelets may be appropriately assigned to each drawstring element 8 on the flap side, which enables the desired tension to be set.

To actuate the drawstring elements 8, a tensioning mechanism 9 is provided which is incorporated in the rear region of the sole 2 and which has an actuating member 10 which can be actuated from above and a release member 11 which can be actuated from outside, and is constructed in such a way that, when the shoe is put on, the heel of the foot of the wearer of the shoe slipping into the shoe presses down the actuating member 10, whereby a tensioning operation is effected, and that the tension can be released by actuation of the release member 11. The sole arrangement, here in the form of the insert sole 6, overlapping the tensioning mechanism 9, can have a recess assigned to the actuating member 10, in which the actuating member 10 engages without a gap and can thus be depressed by direct contact with the heel of the wearer of the shoe. In the example shown, the actuating member 10 is overlapped by the insert sole 6 so that direct heel contact is omitted. A pressure plate 12 made of stiff material, for example a steel plate, which is assigned to the actuating member 10, is embedded in the insert sole 6 to achieve a favorable transmission of force. In the example shown, a reinforcing plate 13 made of load-bearing but lightweight material, such as carbon, is inserted into sole 2 to receive the tensioning mechanism 9, to limit the recess on the sole side downwards and to engage beneath the tensioning mechanism 9.

The tensioning mechanism 9 built into the sole 2 has a housing delimiting a closed interior. As can be seen from FIG. 2, said housing has a pot-shaped housing base 16 and an upper cover 15 assigned to it. Inside the housing there is a winding disc 16, which is mounted so as to be rotatable about its axis and stationary in the axial direction, on which the drawstring elements 8 can be wound for the purpose of tensioning and vice versa. The winding disc 16 can be rotated in the direction of tension by means of the actuating member 10 mentioned above, which passes through an associated bore of the cover 15 in order to be pressed down in the axial direction by the wearer of the shoe. The axial stroke of the actuating member 10 is limited by a stop 10*a* running out on the underside of the cover, which can be designed as a radial collar. The housing lower part 14, the winding disc 16 and the actuating member 10 are shown in detail in FIGS. 4 to 6.

The actuating member 10, which can be depressed in the axial direction by the wearer of the shoe, interacts with the winding disc 16 via a turning device which converts its axial movement into a turning movement of the winding disc 16 and is designed in the manner of an inclined plane. In the example shown, the actuating member 10 made of a cylinder section is provided with screw-thread webs 17 forming an external thread in its lower area. The winding disc 16 contains a central recess 18 and is provided in the area of this recess 18 with screw-thread grooves 19 forming an internal thread so that the actuating member 10 and the winding disc 16 can be brought into mutual screw engagement.

Figure 6:
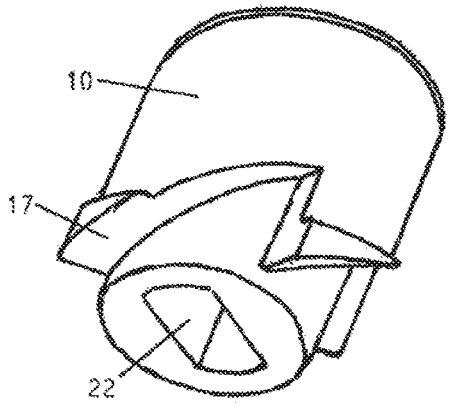
FIG. 6 shows an individual representation of the actuating member.

The housing lower part 14 has a lower base 20 on which the winding disc 16 is mounted so that it can rotate freely. A pin 21 formed on the base 20 in the example shown is projecting from it, which engages in the central recess 18 of the winding disc 16. As can be seen from FIG. 4, this cone 21 has a non-circular cross-section derived in the example shown from a rectangle and cambered on two mutually opposite sides. The actuating member 10 can be plugged onto the pin 21 and, for this purpose, has a recess 22 which is open downwards and has a cross-section corresponding to the non-circular cross-section of the pin 21, as shown in FIG. 6. The actuating member 10 plugged onto the pin 21 is blocked in the direction of rotation as a result of the non-circular cross-section of the pin 21 and the recess 22 and can therefore only move freely in the axial direction. When the actuating member 10 is pressed down, its screw-thread webs 17 engage with the screw-thread grooves 19 of the winding disc 16, causing it to rotate, i.e., the axial movement of the actuating member 10 is converted into a rotary movement of the freely rotatable winding disc 16 by the screw-thread surfaces sliding on each other. The pitch of the sliding screw-thread surfaces of the threaded webs 17 and 19 is conveniently in the range between 23° and 26° and is advantageously exactly 24.5°. This results in an optimum ratio between the required stroke of the actuating member 10 and the angle of rotation of the winding disc 16, and the self-locking effect that has not yet occurred.

Figure 3:
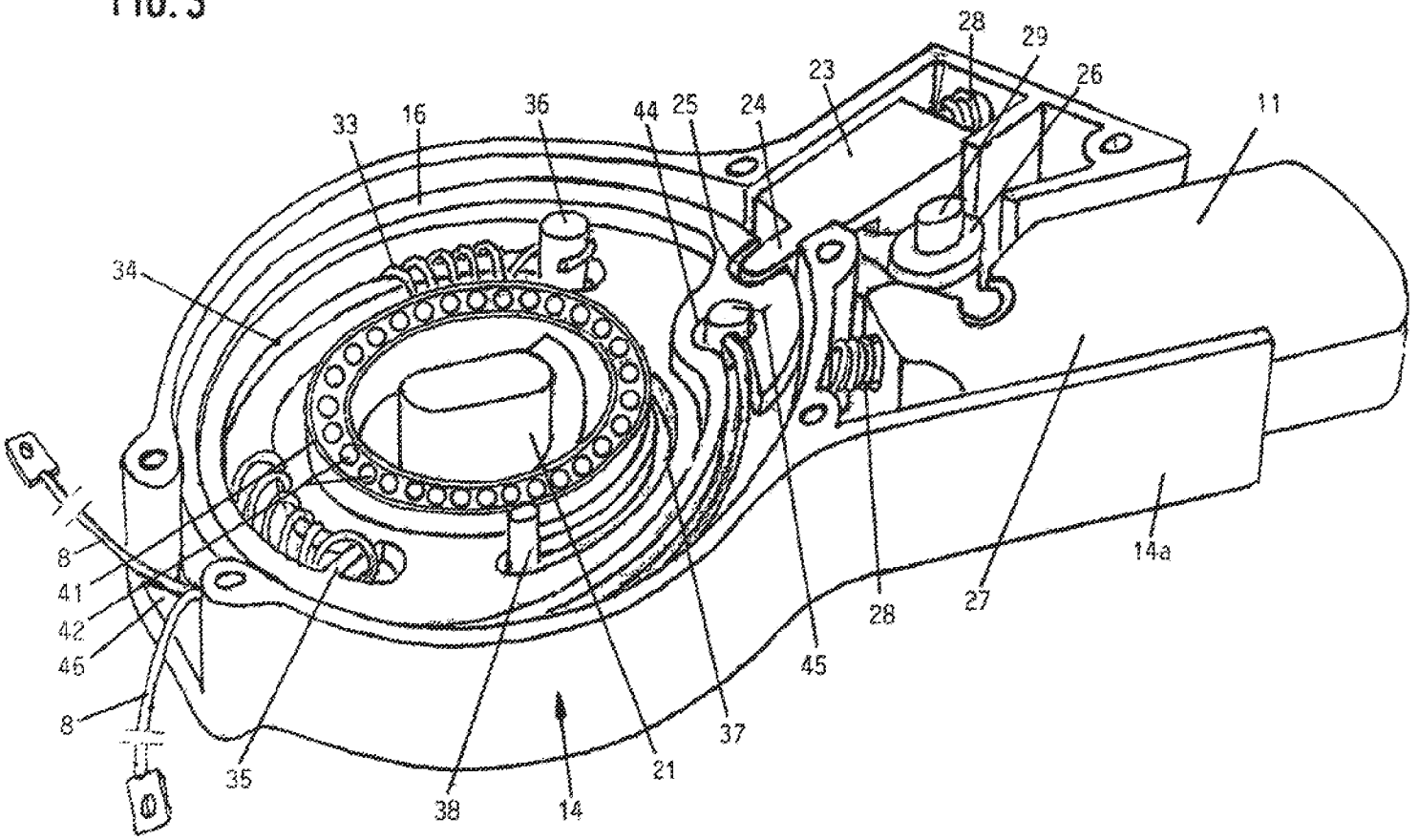
FIG. 3 shows a perspective top view of the device with the cover and actuating member removed according to a first exemplary embodiment of the invention.

The angle of rotation of the winding disc 16 is dimensioned in such a way that the desired tension of the drawstring elements 8 is achieved. In the tensioning position, the winding disc 16, as shown in FIG. 3, is blocked by a blocking device which can be triggered by means of the above-mentioned release member 11. This contains a slider 23 with a latch 24, which can be engaged in the tensioning position of the winding disc 16 in a circumferential recess 25 of the winding disc 16. The recess 25 is arranged in such a way that in the tensioning position of the winding disc 16 it reaches a position covering it with the latch 24, so that said latch can be engaged by the slider 23. The slider 23 interacts via a rocker 26 with another slider 27 containing the release member 11. At least one of the sliders, preferably both sliders 23 and 27, is assigned a spring 28 acting in the engagement direction of the latch 24. This spring arrangement functions accordingly as an engagement spring arrangement, which automatically presses the latch 24 into the recess 25 as soon as it reaches a position covering the latch 24. To disengage the latch 24 and accordingly to release the winding disc 16, the release member 11 is pressed against the spring action of the springs 28. This can be done manually or simply by means of the other shoe. The release member 11 is therefore arranged and designed in such a way that it can be reached from the outside for pressing.

As FIG. 3 clearly shows, the blocking device is located in a radial housing attachment. For this purpose, the housing lower part 14 is provided with a corresponding lug 14*a*. The same of course also applies to the cover 15. The rocker 26 is mounted on a bearing bolt 29 provided on the housing side. As can be seen from FIG. 2, this can be a metal pin whose ends engage in a sleeve 30 or 31 formed on the base 20 on the housing side and the cover 15, which is provided with a suitable mounting hole 32. Of course, it would also be conceivable to form the bearing pin on the housing base 20 and only allow its upper end to engage in a sleeve provided on the cover side and vice versa.

Figure 4:
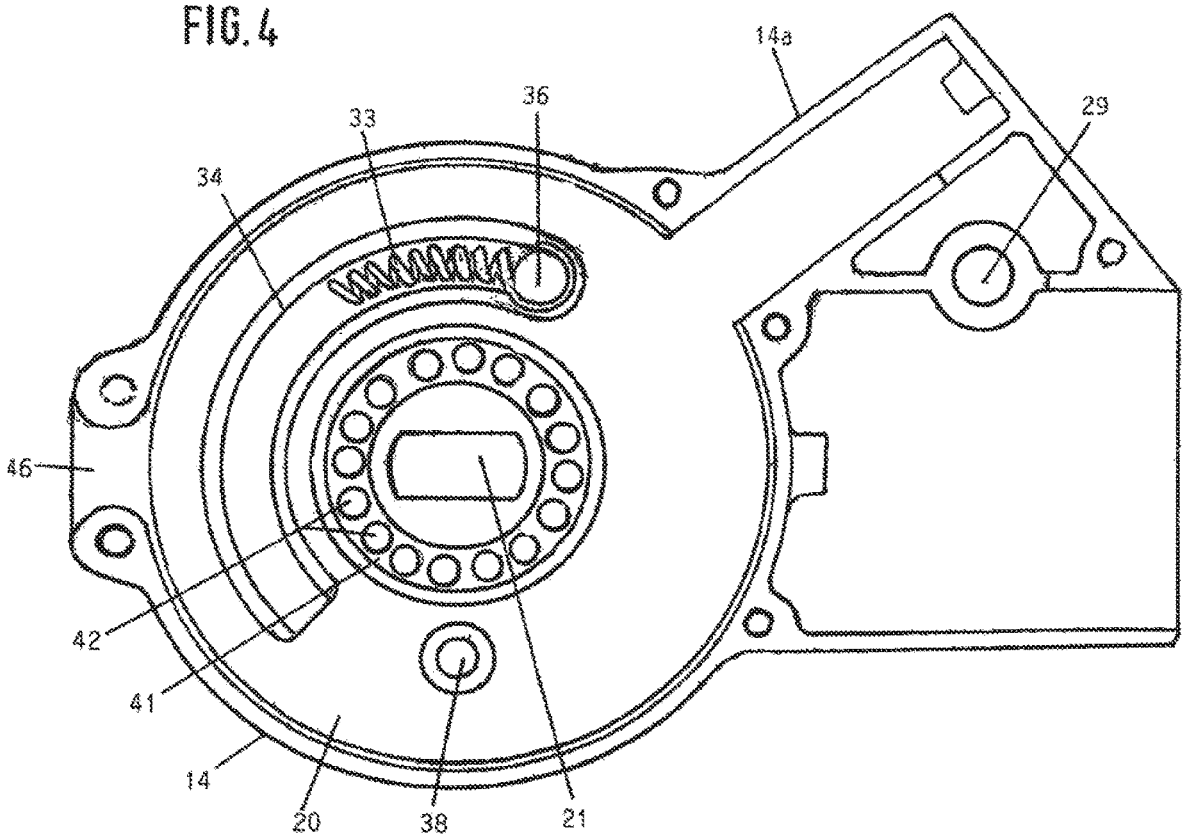
FIG. 4 shows a single representation of the lower part of the housing.

As soon as the release member 11 is pressed and the latch 24 is accordingly brought out of engagement with the associated recess of the winding disc 16, the winding disc 16 and the release member 10 are returned to their initial position. For this purpose, a return spring arrangement acting on the winding disc 16 and/or on the actuating member 10, which is in threaded engagement therewith, is provided. FIG. 3 indicates a return spring 33 acting on the one hand on the winding disc 16 and on the other hand on the housing lower part 14 receiving it. The winding disc 16, as shown in FIGS. 3 and 4, is provided with an arc slot 34 concentric to its central recess 18, in which the return spring 33 is placed. In the example shown, this is designed as a correspondingly curved helical tension spring, which is suspended on the one hand from a web 35 bridging the arc slot 34 and on the other hand from a retaining pin 36 which engages in the arc slot 34 and protrudes from the base 20 of the housing lower part 14. The same applies to retaining pin 36 as has already been stated for bearing pin 29 above. The retaining pin 36 can be integrally formed on or attached to the base 20 of the lower part of the housing 14 and engages with its upper end in a corresponding recess of the cover 15 or vice versa, i.e., the retaining pin 36 could also be integrally formed on or attached to the cover 15 and engage with its lower end in a corresponding recess of the base 20. In addition to or as an alternative to the return spring 33, a return spring assigned to the actuating member 10 could also be provided. This could, for example, be designed as a compression spring placed in recess 22, which is supported on the one hand at the inner end of recess 22 and on the other hand at the end face of pin 21. At least initially, the tensioned drawstring elements 8 also have an additional restoring effect.

Figure 5:
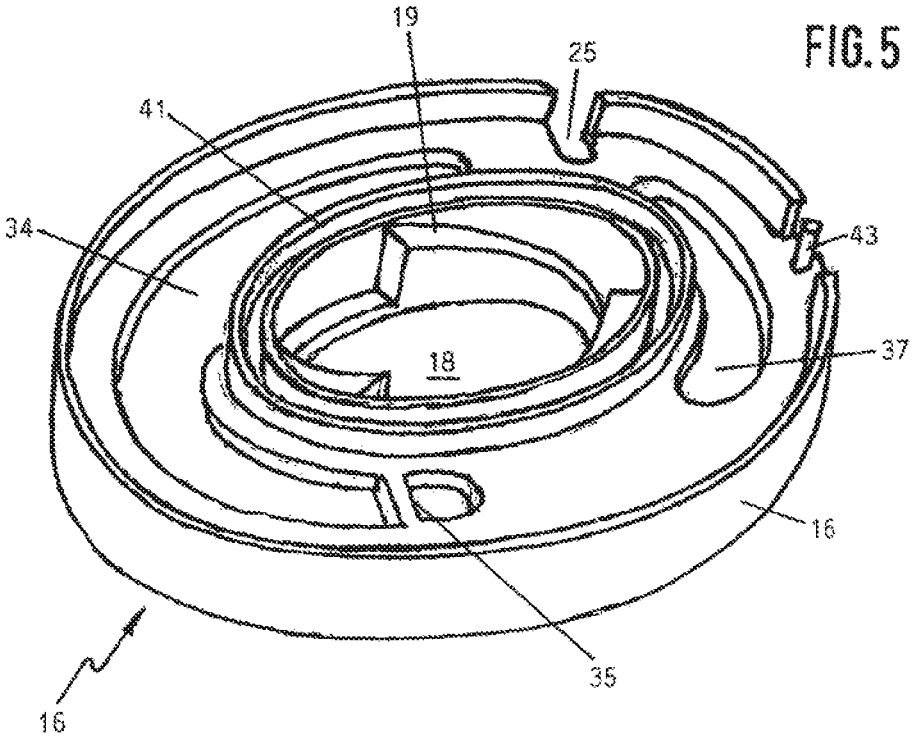
FIG. 5 shows a bottom view of the winding disc according to a second exemplary embodiment of the invention

In order to reliably prevent overwinding of the winding disc 16, it is provided, as FIGS. 3 and 5 further show, with a further arc slot 37 concentric to the central recess 18, in this case opposite the arc slot 34 assigned to the return spring 33, into which a stop pin 38 projecting from the base 20 of the housing lower part 14 engages. The same applies to this stop pin 38 as to the bearing pin 29, i.e., it can be integrally formed on or attached to the base 20 and engage with its upper end in an associated recess in the cover 15 or vice versa be integrally formed on or attached to the cover 15 and engage with its lower end in a recess in the base.

In order to hold the return spring 33, which is designed as a curved helical tension spring, reliably in the associated arc slot 34 of the winding disc 16, it is appropriately supported on the base side and/or on the cover side, in the example shown on both sides. For this purpose, as can best be seen from FIG. 2, the base 20 and the cover 15 are each provided with a correspondingly curved web 39 assigned to the arc slot 34 of the winding disc 16, on which the curved return spring 33 can be supported downwards and upwards. In the example shown, the web 39 is each provided with a corresponding flute or groove 40, in which the return spring 33 can engage on the circumferential side, so that a practically tunnel-shaped receptacle of the return spring 33 is obtained. In the example shown, the cross-section of the groove is adapted to the cross-section of the return spring 33, so that a flat contact or enclosure results. To reduce mutual friction, however, it would also be conceivable to form the groove 40 in such a way that the return spring 33 only comes into contact at the upper edges of the groove opposite each other or has slight play on the circumference.

Figure 2:
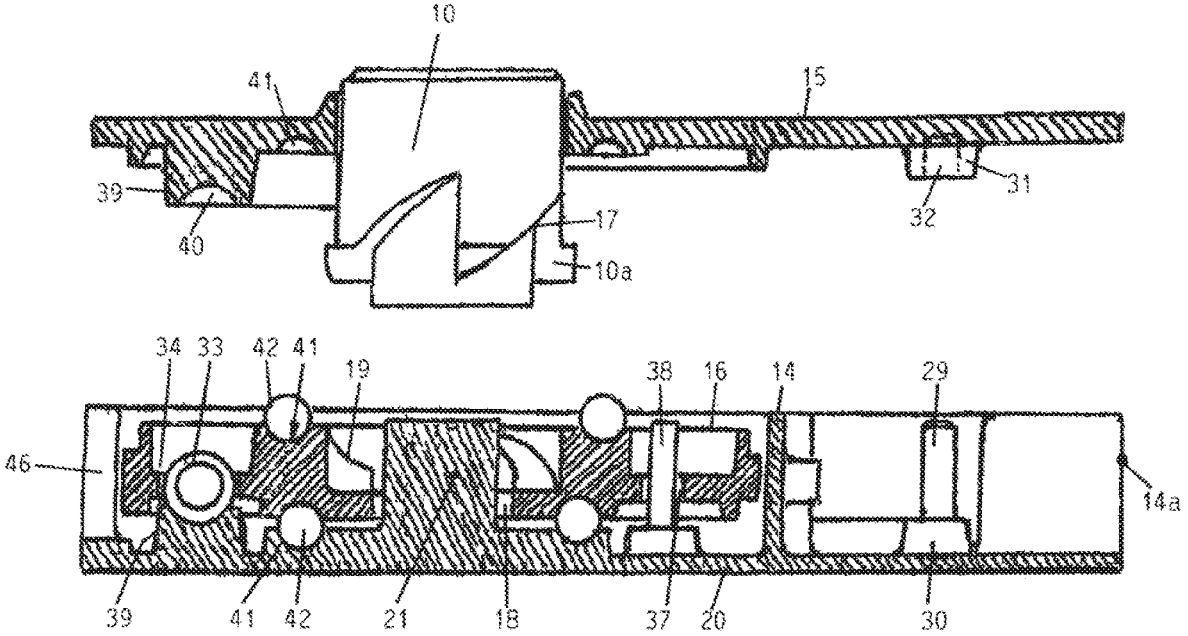
FIG. 2 shows a vertical section through the device in an exploded view according to an exemplary embodiment of the invention.

As can be seen from FIG. 2, the winding disc 16 arranged in the interior of the housing of the tensioning mechanism 9 rests on the base 20 of the housing lower part 14 and is overlapped by the cover 15 which can be attached to it, wherein the winding disc 16 is reliably mounted. In simple cases it is sufficient if the winding disc 16 is mounted on the base 20 of the housing lower part 14, wherein in the example shown a ball bearing is provided. As shown in FIG. 4, the lower part of the housing 14 is provided for this purpose with a track groove 41, which is arranged concentrically to the pin 21 projecting from the base 20 and engaging in the central recess 18 of the winding disc 16 and in which a ball ring 42 is arranged. In addition or alternatively, the underside of the winding disc 14 can also be provided with a corresponding track groove 41 in which the ball ring 42 engages. In the example shown, the ball ring 42 engages on both sides, i.e., at the bottom and at the top, in a respectively associated track groove of the base 20 and the winding disc 16, as clearly shown in FIG. 2, so that a reliable axial bearing and radial bearing is obtained.

In the example shown, a corresponding bearing arrangement is also provided in the area of the top side of the winding disc 16 in accordance with FIG. 2. For this purpose, as shown in FIG. 3, it is provided in the region of its upper side with a track groove 41 concentric with its central passage recess 18, into which a ball ring 42 is inserted, to which a corresponding track groove 41 of the cover 15 is also assigned. With the aid of this ball bearing on both sides of the winding disc 16, it is reliably supported on both sides in axial direction and simultaneously in radial direction.

The above mentioned drawstring elements 8 are wound on the circumference of the winding disc 16 and vice versa when the winding disc 16 is turned. For this purpose, the winding disc 16 is provided in the region of its circumference with at least one hook-in possibility for hooking in an associated drawstring element 8. In FIG. 5, a hook pin 43 is provided for this purpose, which is arranged in the area of the circumference of the winding disc 16 and to which an eyelet provided at the corresponding end of an assigned drawstring element 8 can be attached. For arrangements with only one drawstring element 8, a suspension element, such as the suspension pin 43, is sufficient. The suspension pin 43 shown in FIG. 5 is assigned to the upper side of the winding disc 16. In the case of arrangements with two drawstring elements 8, a corresponding hook-in possibility can also be additionally provided on the underside of the winding disc 16. An arrangement of this kind is indicated in FIG. 3. In the example on which FIG. 3 is based, the hook-in possibility for a drawstring element 8 provided in the area of the circumference of the winding disc 16 is designed as an undercut blind hole 44, into which a button 45 attached to the corresponding end of the associated drawstring element 8 can be inserted. FIG. 3 shows two drawstring elements 8. Accordingly, the winding disc 16 is provided with a corresponding hook-in possibility at the top and bottom, here in the form of the undercut recess 44. Similarly, the hook-in possibility shown in FIG. 5 could also be provided at the top and bottom.

As can be seen from FIGS. 3 and 4, the drawstring elements 8, which can be wound onto the winding disc 16, are guided out of the housing interior via a common circumferential opening 46 of the housing, or several openings respectively assigned thereto, here of the housing lower part 14, wherein a deflection takes place at one edge of the window-shaped opening 46. To counteract wear, the edge in question can be rounded off and thickened accordingly, as shown in FIGS. 3 and 4. The drawstring elements leading out of the housing via the openings 46 can run outside the housing in a channel 47 indicated in FIG. 1 on the sole side, which is covered on the outside. If necessary, an additional return spring arrangement can be provided in this channel, through which the assigned drawstring element 8 passes and which is supported hereon on the one hand and on the other hand on the channel side.

Although an exemplary embodiment of the invention is explained in more detail above, this is not intended to be a limitation. For example, it would easily be conceivable that the winding disc 16 is not circular, but oval or elliptical in shape, whereby the winding-up travel per angle of rotation can be increased in a partial area of the circumference, so that even with a comparatively small angle of rotation of the winding disc 16, the desired shortening of the drawstring elements 8 and accordingly the desired tension can be achieved.

What is claimed is:

1. A device for actuating a drawstring in a shoe provided with a drawstring device, the device comprising:

a winding member, which is arranged rotatably in a carrier embedded in the sole of the shoe, is stationary in an axial direction and on which at least one drawstring element, which can be wound onto it, engages, an actuating member, which can be moved in the axial direction relative to the winding member, can be depressed by the wearer of the shoe and is thereby blocked in a direction of rotation and is in screw engagement with the winding member, which can be rotated in a tensioning direction by depression of the actuating member and which can be blocked in a position of tension by means of a blocking device which can be released by means of a release member, a return spring arrangement which counteracts the force exerted by the wearer of the shoe and acts on the winding member and/or actuating member, and, when the blocking device is released, resets the winding member and the actuating member to the respective starting position when the blocking device is released, wherein the carrier has a fixed pin, which is assigned to a central through recess of the winding member, that has a non-circular cross-section and onto which the actuating member, which has a corresponding recess can be fitted with freedom of movement in the axial direction, wherein the carrier, which is embedded in the sole of the shoe, is formed as a closed housing with a base, from which the pin projects, and has a cover through which an upper pushbutton of the actuating member passes and a radial housing attachment for the release member, which can be actuated from the outside, and wherein the winding member is designed as a winding disc, which is mounted on ball bearings with respect to the base and/or the cover of the housing, and wherein, in order to form a simultaneous axial and radial bearing, a circumferential ball ring is provided which runs at least above or below in an associated circumferential track groove on the winding member.

2. The device according to claim 1, wherein the winding disc is provided in the region of its central recess with screw-thread grooves arranged in a manner of an internal thread and the actuating member designed as a cylinder section is provided in the region of its lower area, which can be screwed into the winding disc with corresponding screw-thread webs arranged in the manner of an external thread.

3. The device according to claim 1, wherein the screw-thread surfaces of the winding disc and actuating member have a pitch of 23°-26°.

4. The device according to claim 1, wherein the winding disc has an arc slot which is concentric relative to its central through recess and in which a return spring acting as the return spring arrangement is accommodated which is designed as a correspondingly curved helical tension spring and which engages on the one hand on the winding disc and on the other hand on a retaining pin which is fixed to the housing and preferably projects from the base of the housing and engages in the arc slot.

5. The device according to claim 4, wherein the base and/or cover of the housing has or have in each case a guide groove assigned to the return spring.

6. The device according to claim 1, wherein the winding disc has a further arc slot which is concentric relative to its central through recess and in which a stop pin engages which is fixed to the housing and projects from the base of the housing and delimits a rotation of the winding disc.

7. The device according to claim 1, wherein the winding disc has at least one suspension element provided in the region of its circumference for suspending an associated drawstring element which can be guided out of the housing via a circumferential housing opening.

8. The device according to claim 1, wherein the upper pushbutton of the actuating member, which penetrates the cover of the housing, is associated with a pressure plate of comparatively rigid material which is embedded in a recess of an insole or insert sole of the shoe.

9. The device according to claim 1, wherein:

the radial housing attachment accommodates a radially movable latch, which can be brought into engagement in a circumferential latching recess of the winding disc, and the release member is biased radially outward.

10. The device according to claim 9, wherein spring-loaded sliders are respectively associated with the latch and the release member, said sliders cooperate with one another via a rotatable, two-armed rocker.

11. The device according to claim 1, wherein the screw-thread surfaces of the winding disc and actuating member have a pitch of 24.5°.

* * * * *